US006152813A

United States Patent [19]

Suzuki

[11] Patent Number: 6,152,813

[45] Date of Patent: Nov. 28, 2000

[54] DRESSER AND DRESSING APPARATUS

[75] Inventor: Toshinaru Suzuki, Ayase, Japan

[73] Assignee: Speedfam Co., Ltd., Japan

[21] Appl. No.: 09/134,695

[22] Filed: Aug. 14, 1998

[30] Foreign Application Priority Data

Oct. 21, 1997 [JP] Japan ..... 9-306621

[51] Int. Cl.[7] ..... B24B 21/18

[52] U.S. Cl. ..... 451/443

[58] Field of Search ..... 451/162, 443, 451/444, 56

[56] References Cited

U.S. PATENT DOCUMENTS

| | | | |
|---|---|---|---|
| D. 362,019 | 9/1995 | Anthony et al. | D4/118 |
| 4,760,619 | 8/1988 | Lundin | 15/142 |
| 5,091,753 | 2/1992 | Slapelis | 355/297 |
| 5,421,768 | 6/1995 | Fujiwara et al. | 451/283 |
| 5,427,644 | 6/1995 | Nagatsuka et al. | 156/344 |
| 5,518,542 | 5/1996 | Matsukawa et al. | 118/52 |
| 5,651,160 | 7/1997 | Yonemizu et al. | 15/302 |
| 5,746,302 | 5/1998 | Bowman | 198/496 |
| 5,802,667 | 9/1998 | Williams | 15/395 |
| 5,806,137 | 9/1998 | Ishi et al. | 15/302 |

FOREIGN PATENT DOCUMENTS

| | | |
|---|---|---|
| 54-129891 | 8/1979 | Japan . |
| 54-129891 | 9/1979 | Japan . |
| 4-364730 | 12/1992 | Japan . |
| 0-69502 | 3/1997 | Japan . |

*Primary Examiner*—Joseph J. Hail, III
*Assistant Examiner*—Dermott J. Cooke
*Attorney, Agent, or Firm*—Fitch, Even, Tabin & Flannery

[57] ABSTRACT

A dresser and a dressing apparatus able to reduce the labor involved in the dressing work and obtain a sufficient dressing effect. The dressing apparatus 1 is provided with a dresser 2 and a dresser drive apparatus 3. The dresser 2 has brushes 11*a* and 11*b* formed on the upper and lower surfaces of the dresser body 10 and scrapers 12*a* and 12*b* provided in the longitudinal direction of the dresser body 10. The dresser drive apparatus 3 has a swing mechanism for swinging the dresser 2 in the radial direction of the platens. Preferably springs for biasing the scrapers 12*a* and 12*b* in the outward direction are provided in the dresser body 10.

6 Claims, 11 Drawing Sheets

DRESSER AND DRESSING APPARATUS

BACKGROUND OF THE INVENTION

1. Field of the Invention

The present invention relates to a dresser for dressing a polishing surface of a platen of a polishing apparatus and a dressing apparatus for the same.

2. Description of the Related Art

In a polishing apparatus, for example, a two-side polishing apparatus, an upper platen and lower platen gripping workpieces held in carriers from above and below are made to rotate in mutually opposite directions so as to simultaneously polish the two surfaces of the workpieces by pads attached to the upper platen and lower platen.

If this apparatus is used for a long time, however, the abrasive, chips, etc. penetrate and clog the pads and cause the polishing rate to remarkably fall. Therefore, "dressing" has been performed to scrape off the abrasive etc. clogging the pads.

FIG. 18 is a schematic side view of an example of the dressing technique of the related art, while FIG. 19 is a schematic side view of another example.

The technique shown in FIG. 18 is one in which the platen 100 which has become clogged is removed from the polishing apparatus and the surface of the pad 101 is shaved by a knife edge 200 to scrape off the abrasive etc. clogging the pad 101.

As opposed to this, the technique shown in FIG. 19 is the technique described in Japanese Unexamined Patent Publication (Kokai) No. 4-364730, where rotating brushes 300 are pressed against the pad 101 of the rotating platen 100 and, in that state, the brushes 300 are moved in the radial direction so as to scrape off the abrasive etc. impregnated in the pad 101.

Further, as similar art, there is the technique described in Japanese Unexamined Utility Model Publication (Kokai) No. 54-129891.

In the above related art, however, there were the following problems:

In the technique shown in FIG. 18, it was necessary to remove the platen 100 from the polishing apparatus each time so trouble was involved. Further, since the worker had to perform the dressing manually, the burden on the worker was high.

On the other hand, in the technique shown in FIG. 19 and the technique described in Japanese Unexamined Utility Model Publication (Kokai) No. 54-129891, the dressing was performed automatically, so the burden on the worker was lightened, but since just brushes 300 were used to try to scrape off the abrasive etc., a sufficient dressing effect could not be obtained.

SUMMARY OF THE INVENTION

The present invention was made so as to solve the above problems and has as its object to provide a dresser and a dressing apparatus which help reduce the labor involved in dressing work and which enable a sufficient dressing effect to be obtained.

To achieve this object, the dresser according to a first aspect of the invention comprises a dresser body, a brush formed on the surface of the dresser body, and a knife-edge scraper of a predetermined length projecting from the surface where the brush is formed.

Due to this configuration, by pressing the surface of the dresser body where the brush is formed and the scraper is provided toward the platen side of the polishing apparatus to press the brush and the scraper against the surface of the platen and making the platen rotate in that state, the abrasive etc. clogging the pad etc. on the surface of the platen are scraped off by the cooperative action of the brush and the scraper.

Further, the invention is comprised of the dresser, wherein a brush is formed on and a long rectangular scraper is provided from both the upper surface and the lower surface of the dresser body.

With this configuration, by gripping the upper and lower surfaces of the dresser body by the upper and lower platens and making the upper and lower platens rotate in a state where the scrapers are oriented in the radial direction of the platens of a two-side polishing apparatus, the pads etc. of the upper and lower platens are dressed by the brushes and scrapers provided on the upper and lower surfaces.

The scrapers do not have to be fixed to the upper and lower surfaces of the dresser body. As one example, the invention comprises the dresser, wherein long rectangular holes are provided in the upper surface and lower surface of the dresser body, scrapers are fit into the holes from the inside of the dresser body, and the scrapers are biased to project out from the dresser body by biasing members.

Due to this configuration, the scrapers can follow any inclination of the pads etc. of the platens.

In particular, the invention comprises the dresser, wherein the scrapers are divided into a plurality of scraper pieces and the plurality of scraper pieces are biased by a plurality of biasing members so as to enable the scraper pieces to follow complicated unevenness occurring in the pads etc. of the platens.

Further, the invention is not, as shown in the inventions, limited to provision of the brushes and scrapers on just the upper and lower surfaces of the dresser body. As one example, the invention of claim 5 comprises the dresser, wherein the dresser body is formed into a substantially cylindrical shape or columnar shape, the brush is formed on the surface of the dresser body, and the scraper is provided in a spiral shape in the longitudinal direction of the dresser body.

With this configuration, by pressing the dresser body in the radial direction of the platens of a two-side polishing apparatus and making the dresser gripped between rotating upper and lower platens rotate, the surfaces of the upper and lower platens are dressed by the brush and scraper and the abrasive etc. are scraped off in the radial direction of the platens by the rotation of the spiral scraper.

Further, the dresser body does not have to be a columnar shape etc. and may be a disk or other shape.

As one example, the invention comprises the dresser set, wherein the dresser body forms a gear shape able to engage with a sun gear and internal gear of a two-side polishing apparatus and wherein brushes are formed and scrapers are provided on each of the two surfaces of the dresser body.

With this configuration, by making the dresser body engage with the sun gear and the internal gear of the two-side polishing apparatus and making the upper and lower platens rotate in a state gripping the two surfaces between them, the dresser body will rotate and revolve around the sun gear. As a result, the surfaces of the upper and lower platens will be dressed by the rotating and revolving brushes and scrapers.

The scrapers provided on the two surfaces of the dresser body may be made any shape. As one example, the invention comprises the dresser set forth, wherein the scrapers are formed in circular shapes substantially concentric with the center of the dresser body or straight shapes extending in the radial direction from the center of the dresser body.

Further, the dresser of the present invention is not limited to a two-side polishing apparatus and may also be applied to a single-side polishing apparatus. As one example, the invention comprises the dresser, wherein the dresser body forms a disk shape able to be housed in a workpiece holding portion of a head of a single-surface polishing apparatus and the brush is formed and the scraper provided on the lower surface of the dresser body.

With this configuration, by housing the dresser body in the workpiece holding portion of the head and making the head rotate while pressing the dresser body on it, the surface of the platen is dressed by the brush and scraper provided on the lower surface of the dresser body.

Further, the invention comprises the dresser, wherein the scraper is formed in a circular shape substantially concentric with the center of the dresser body or a straight shape extending in the radial direction from the center of the dresser body.

Further, to achieve the above object, the dressing apparatus according to a second aspect of the invention set forth comprises a dresser having a dresser body, brushes formed on the upper surface and lower surface of the dresser body, and long rectangular knife-edge scrapers provided on the surfaces where the brushes are formed and a swing mechanism for making the dresser gripped between the upper platen and lower platen of a two-side polishing apparatus and with scrapers oriented in the radial direction of the upper platen and lower platen swing in the above radial direction.

With this configuration, by making the dresser swing in the radial direction of the upper and lower platens by this swing mechanism, the abrasive etc. are scraped off in the swing direction.

The above swing mechanism may be any one which makes the dresser swing in the radial direction of the upper and lower platens. As one example, the invention comprises the dressing apparatus set forth, wherein the swing mechanism is provided with a slider linked to the base portion of the dresser, a link with one end pivotally supported by the slider, a crank by which the other end of the link is pivotally supported to an eccentric position, and a drive unit for making the crank turn.

Further, the invention comprises the dresser of the dressing apparatus set forth in, wherein long rectangular holes are provided in the upper surface and lower surface of the dresser body, scrapers are fit into the holes from the inside of the dresser body, and the scrapers are biased to project out from the dresser body by biasing members. Further, the invention comprises the dresser of the dressing apparatus set forth, wherein the scrapers are divided into a plurality of scraper pieces and the plurality of scraper pieces are biased by a plurality of biasing members.

Further, to achieve the above object, the dressing apparatus according to a third aspect of the invention comprises a dresser having a substantially cylindrical or columnar dresser body, a brush formed on the surface of the dresser body, and a knife-shaped scraper provided on the surface of the dresser body in a spiral form along the longitudinal direction of the dresser body and a rotating mechanism for making the dresser gripped between an upper platen and lower platen of a two-side polishing apparatus and with a dresser body oriented in the radial direction of the upper platen and lower platen rotate in a circumferential direction.

With this configuration, by making the dresser rotate by the rotating mechanism, the abrasive etc. are scraped off in the radial direction of the platens by the rotating spiral scraper.

BRIEF DESCRIPTION OF THE DRAWINGS

The above and other objects, features, and advantages of the present invention will become more readily apparent from the following detailed description of a presently preferred embodiment of the invention taken in conjunction with the accompanying drawings, in which.

DESCRIPTION OF THE PREFERRED EMBODIMENTS

Embodiments of the invention will be explained next with reference to the drawings.

Figure 1:
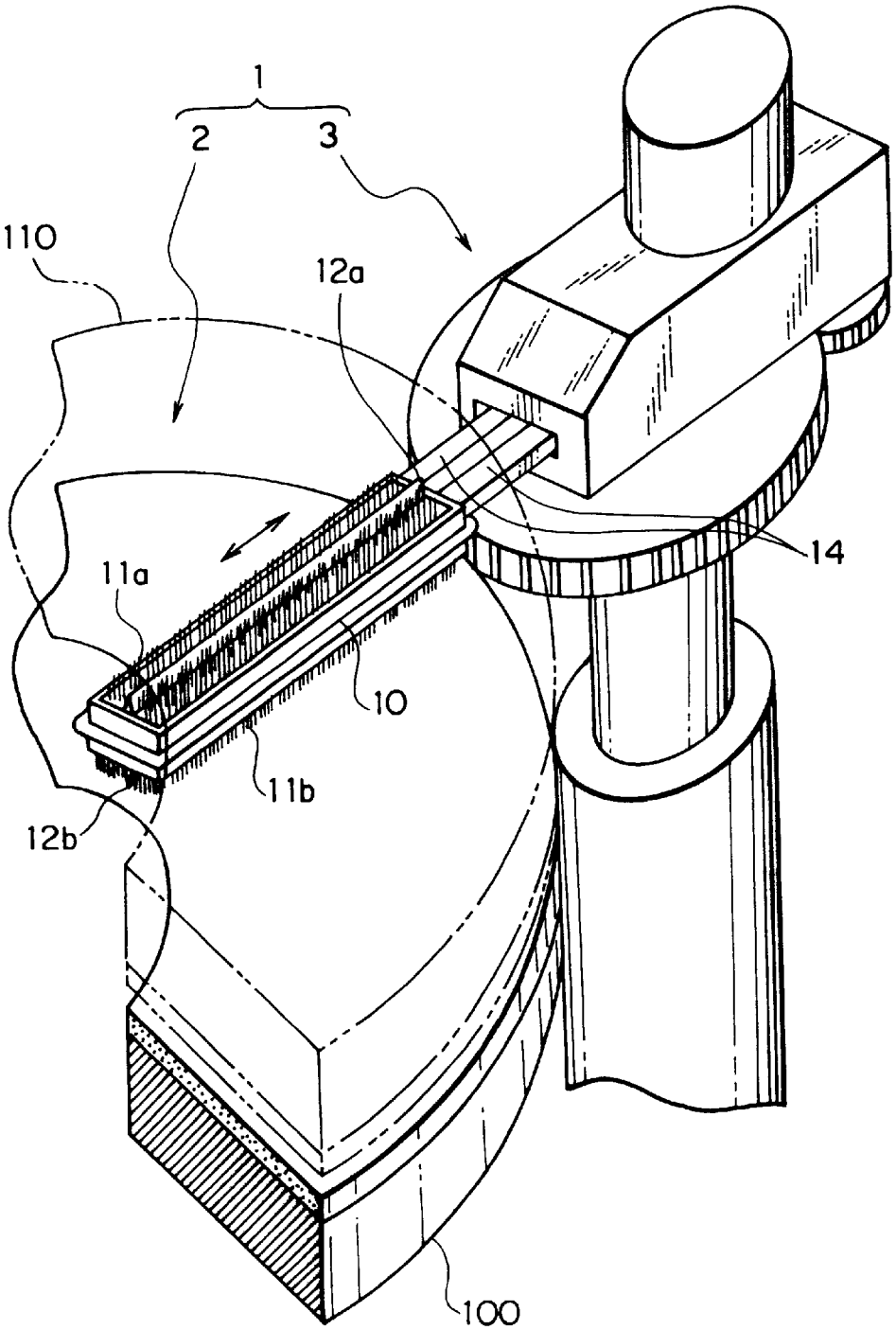
FIG. 1 is a perspective view of a dressing apparatus according to a first embodiment of the present invention.

FIG. 1 is a perspective view of a dresser according to a first aspect of the invention set forth in claims 1 to 4 and a dressing apparatus according to a second aspect of the invention.

In FIG. 1, reference numeral 1 is a dressing apparatus, reference numeral 100 is a lower platen, and reference numeral 110 is an upper platen.

As shown in FIG. 1, the dressing apparatus 1 is comprised of a dresser 2 and a dresser drive apparatus 3.

The dresser 2 is a device for dressing the lower platen 100 and the upper platen 110. As shown in FIG. 1, it is provided with brushes 11*a* and 11*b* and scrapers 12*a* and 12*b* on the lower surface and upper surface of the dresser body 10.

Figure 2:
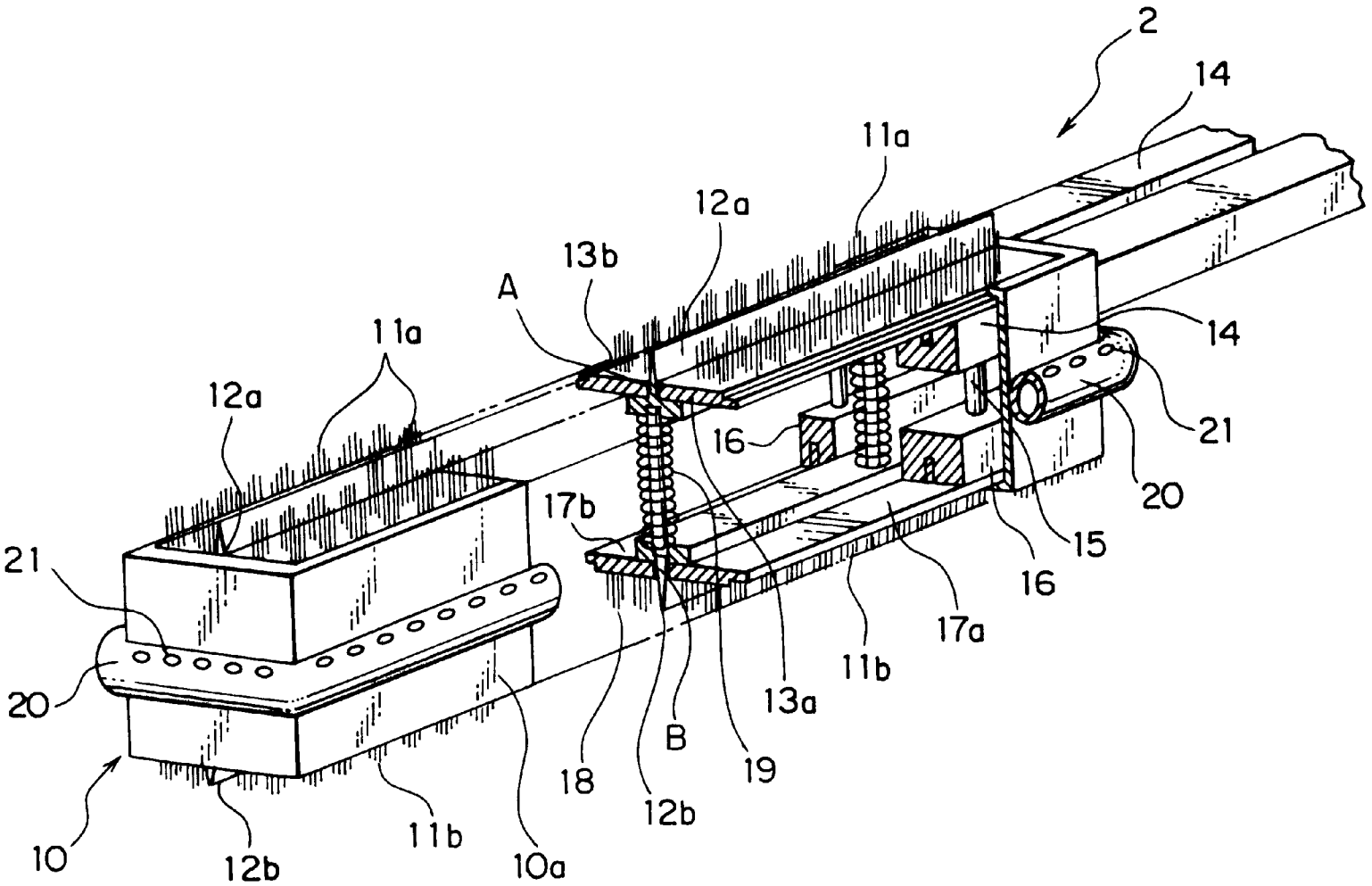
FIG. 2 is a partially cut away perspective view of a dresser.
Figure 3:
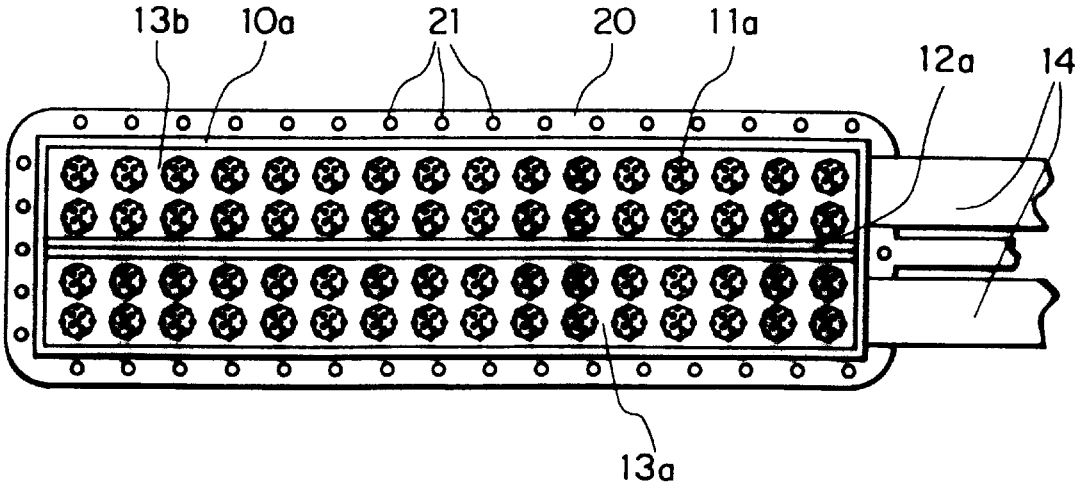
FIG. 3 is a plan view of the dresser.
Figure 4:
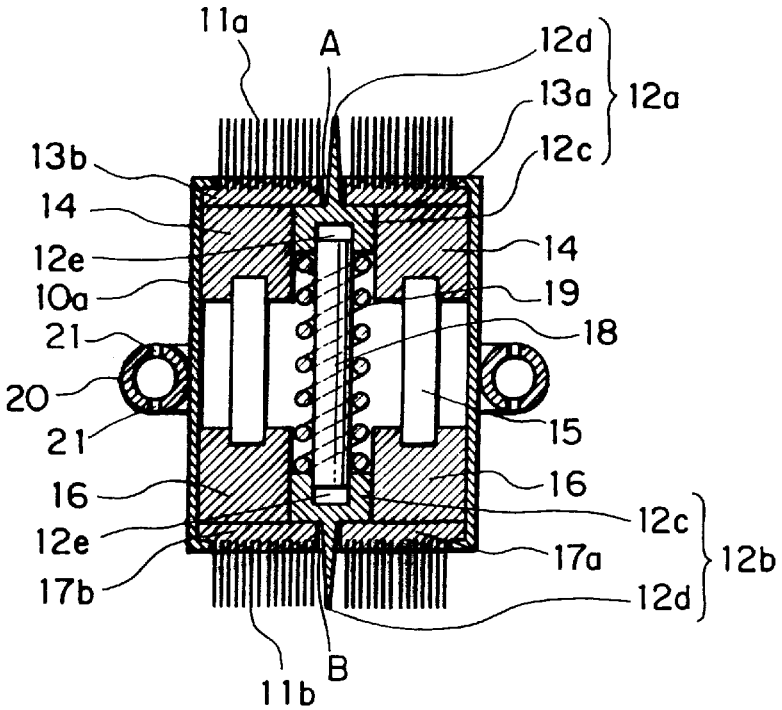
FIG. 4 is a front sectional view of the dresser.

FIG. 2 is a partially cut away perspective view of the specific structure of the dresser 2, FIG. 3 is a plan view of the dresser 2; and FIG. 4 is a front sectional view of the dresser 2.

As shown in these figures, two brush platens 13*a* and 13*b* arranged in parallel a predetermined interval A apart are bolted to a brush base 14 forming a base portion of the dresser 2. The brush base 14 is linked to a pair of brush bases 16 on the bottom side through a shaft 15. Upper brush platens 13*a* and 13*b* and lower brush platens 17*a* and 17*b* of the same shape are bolted in parallel at predetermined intervals B apart to these brush bases 16. A case 10*a* is fixed over the assembly comprised of these upper brush platens 13*a* and 13*b*, the brush bases 14 and 16, and the lower brush platens 17*a* and 17*b* so as to constitute the dresser body 10.

The brush 11*a* is formed by implanting bristles of predetermined lengths made of Derlin, Poly-Plastecs etc. over the entire upper surfaces of the upper brush platens 13*a* and 13*b* of the dresser body 10. The brush 11*b* is formed by implanting bristles of the same material and same lengths as the brush 11*a* over the entire lower surfaces of the lower brush platens 17*a* and 17*b*.

The scrapers 12*a* and 12*b* are provided inside such a dresser body 10.

Specifically, as shown in FIG. 4, the scrapers 12*a* and 12*b* have long rectangular base portions 12*c* and blade portions 12*d*.

The base portions 12*c* of the scrapers 12*a* and 12*b* are arranged inside the dresser body 10 and are supported by guide shafts 18 with two ends loosely engaged in the holes 12*e*. On the other hand, the blade portions 12*d* of the scrapers 12*a* and 12*b* are fit into gaps A and B forming the long rectangular holes.

A spring 19 is attached to each of the guide shafts 18 as a biasing member. The springs 19 bias the scrapers 12*a* and 12*b* so as to make the blade portions 12*d* project out from the dresser body 10.

A pipe 20 formed with a plurality of holes 21 at its upper and lower surface is wrapped around the dresser 2. Pure water is supplied inside the pipe 20 from a not shown pump, whereby pure water is sprayed through the plurality of holes 21 upward and downward.

In FIG. 1, the dresser drive apparatus 3 is an apparatus for driving the dresser 2 and is provided with a swing mechanism for making the dresser 2 swing, a rotating mechanism for making the dresser rotate, and an elevating mechanism for making the dresser 2 rise and descend.

Figure 5:
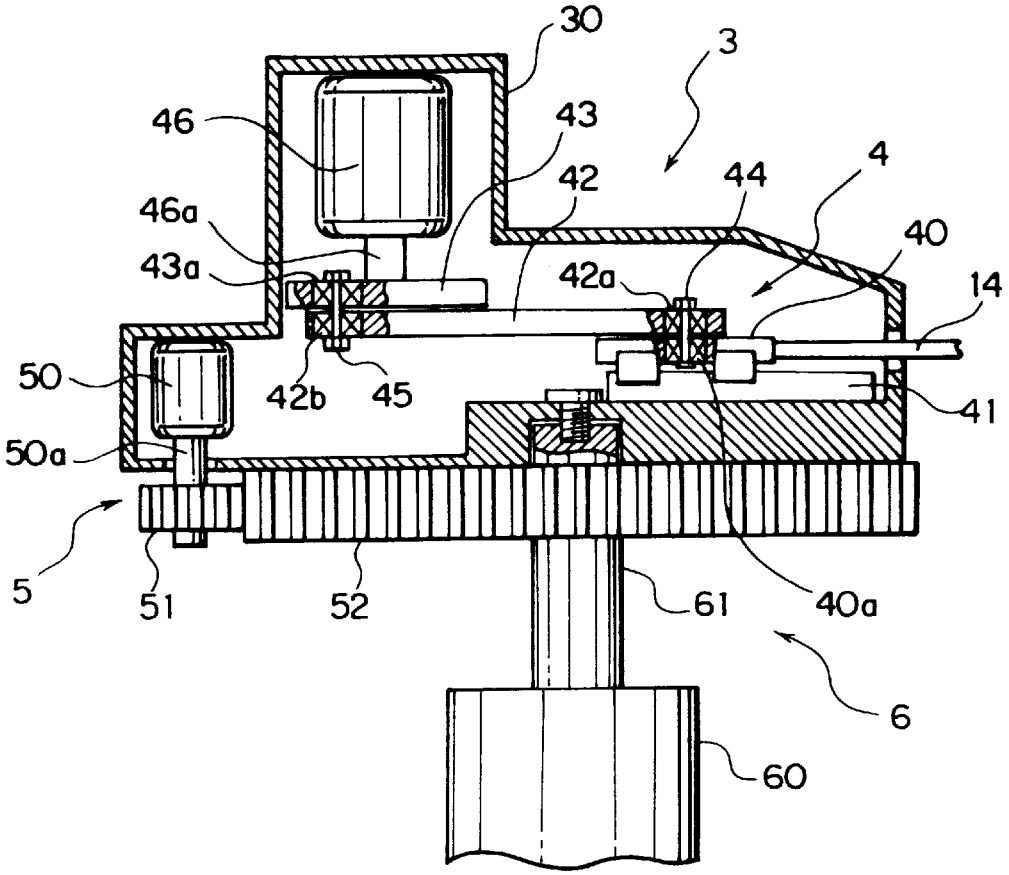
FIG. 5 is a side sectional view of the structure of a dresser drive apparatus.
Figure 6:
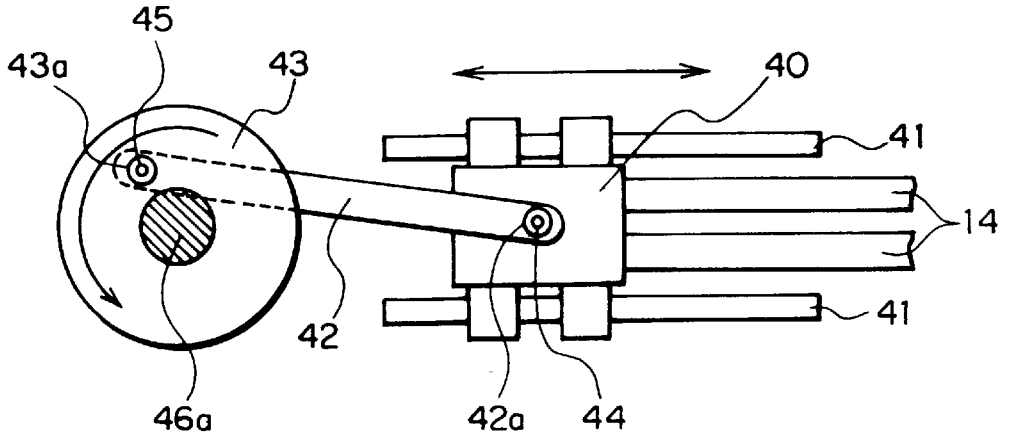
FIG. 6 is a plan view of a swing mechanism.

FIG. 5 is a side sectional view of the structure of the dresser drive apparatus 3, while FIG. 6 is a plan view of the swing mechanism.

In FIG. 5, reference numeral 4 is a swing mechanism, reference numeral 5 is a rotating mechanism, and reference numeral 6 is an elevating mechanism.

The swing mechanism 4 has a slider 40 linked with the brush base 14 (see FIG. 1) extending out from behind the case 10*a* of the dresser 2. The slider 40 is designed to swing on a pair of parallel guide rails 41 as shown by the arrow. Further, the slider 40 is linked with a disk shaped crank 43 through a link 42.

Specifically, a pin 44 attached to a bearing 40*a* attached to the slider 40 is linked to a bearing 42*a* provided at the right end of the link 42. The link 42 therefore rotates around the pin 44. Further, a pin 45 is attached to the left end of the link 42 through a bearing 42*b*. The pin 45 is linked with a bearing 43*a* provided at an eccentric position of the crank 43.

Further, a center of the crank 43 is linked to a shaft 46*a* of a motor 46 functioning as the drive unit fixed to the case 30 of the dresser drive apparatus 3.

By driving the motor 46 and making the crank 43 rotate, the left end of the link 42 rotates together with the crank 43 and the slider 40 reciprocates on the guide rail 41. As a result, the dresser 2 linked to the slider 40 through the brush base 14 swings in the longitudinal direction.

Further, the rotating mechanism 5 has a motor 50 fixed in the case 30 of the dresser drive apparatus 3. By making the gear 51 fixed to the front end of the shaft 50*a* of the motor 50 rotate, it is possible to make a gear 52 fixed to the later mentioned piston rod 61 rotate.

The case 30 of the dresser drive apparatus 3 is placed and fixed to the upper surface of the gear 52. It rotates together with the gear 52 and enables a pivoting motion of the dresser 2.

The elevating mechanism 6 is comprised of a cylinder 60 for making the case 30 in which the above swing mechanism 4 and rotating mechanism 5 are assembled rise and descend.

Specifically, the gear 52 is fixed to the upper part of the piston rod 61, while the bottom of the case fixed to the gear 52 is linked with the top end of the piston rod 61.

Next, an example of use of the dressing apparatus 1 of this embodiment will be explained.

Figure 7A:
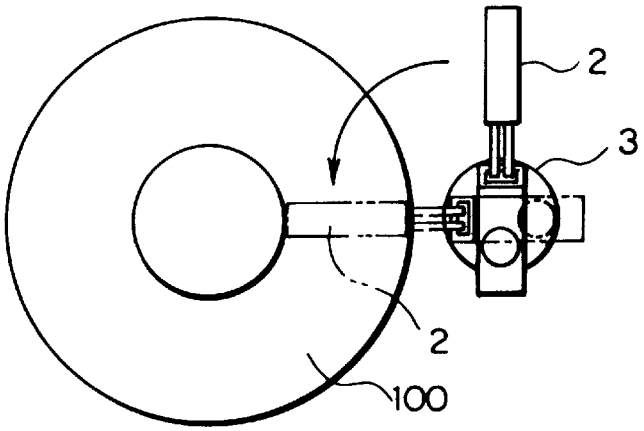
FIG. 7A to FIG. 7C are schematic views of the dressing operation.
Figure 7B:
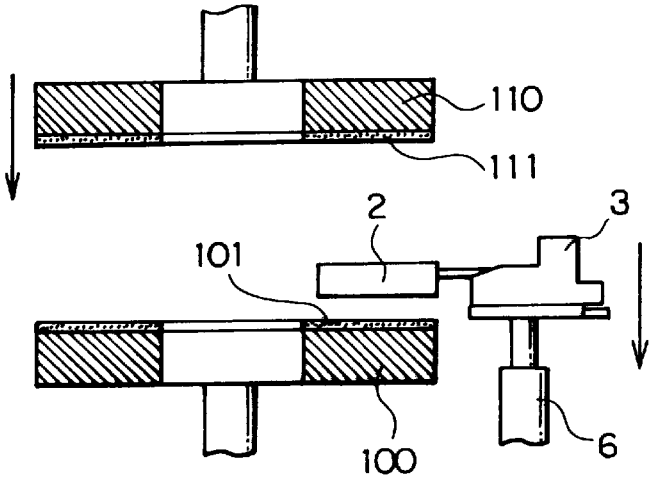
Figure 7C:
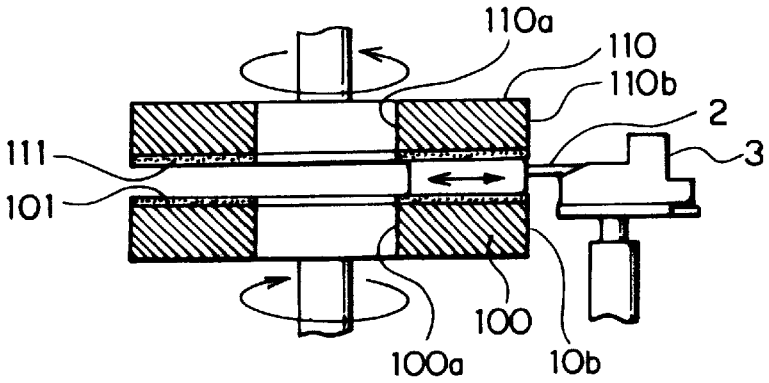

FIG. 7A to FIG. 7C are schematic views of the dressing operation.

First, the dressing apparatus 1, as shown in FIG. 1, is arranged near the two-side polishing apparatus. The motor 50 of the rotating mechanism 5 shown in FIG. 5 is driven to make the dresser drive apparatus 3 rotate, then, as shown by the dot-dash line in FIG. 7A, the dresser 2 is turned to position the dresser 2 directly above the lower platen 100 oriented in the radial direction of the lower platen 100.

In this state, as shown in FIG. 7B, the cylinder 60 of the elevating mechanism 6 shown in FIG. 5 is driven to make the dresser 2 descend along with the dresser drive apparatus 3 and make the brush 11*b* and the blade portion 12*d* of the scraper 12*b* below the dresser 2 (see FIG. 2 to FIG. 4) contact the pad 101 of the lower platen 100.

Suitably thereafter, as shown in FIG. 7C, the lower platen 110 is made to descend to bring the pad 111 into contact with the brush 11*a* and the blade portion 12*d* of the scraper 12*a* and press the dresser 2 by a predetermined pressure.

In this state, the lower platen 100 and the upper platen 110 are made to rotate in mutually opposite directions, the motor 46 of the swing mechanism 4 shown in FIG. 5 is driven, and the dresser 2 as a whole is made to swing in the radial direction of the lower platen 100.

At this time, the swing distance of the dresser 2 is set so that the front end of the dresser 2 passes the center holes 100*a* and 110*a* of the lower platen 100 and the upper platen 110 and the rear end passes the outer circumferences 100*b* and 110*b* of the lower platen 100 and upper platen 110. Further, pure water is supplied to the pipe 20 shown in FIG. 2 to FIG. 4 to spray pure water from the plurality of holes 21 toward the pad 101 or pad 111.

Figure 8:
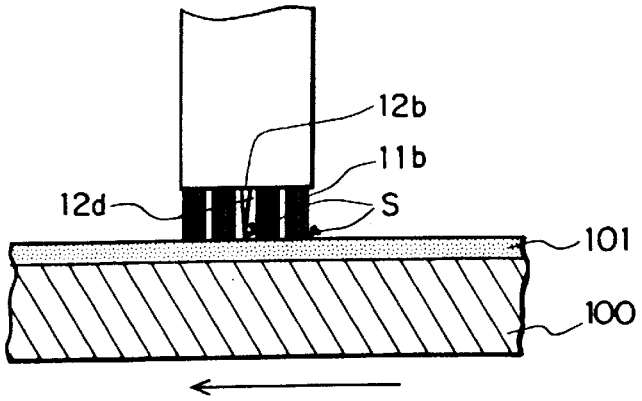
FIG. 8 is a sectional view showing the dressing operation on a pad.
Figure 9:
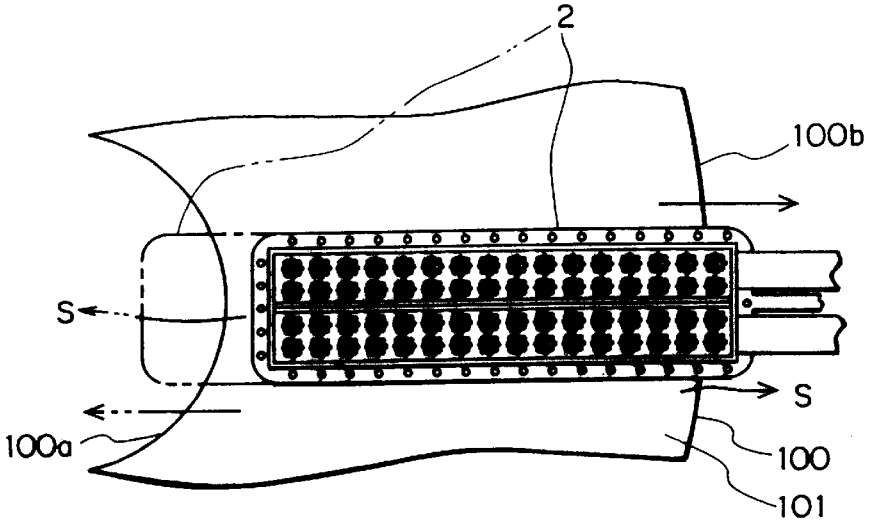
FIG. 9 is a schematic plan view showing a discharge operation by the swing.

FIG. 8 is a sectional view showing the dressing operation on the pad 101, while FIG. 9 is a schematic plan view showing a discharge operation by the swing.

As shown in FIG. 8, if the lower platen 100 rotates in the arrow direction, the abrasive S etc. clogging the pad 101 will be scraped off by the brush 11*b* pressing against the pad 101 and the abrasive S not scraped off by the brush 11*b* will be scraped off by the blade of the blade portion 12*d* of the scraper 12*b*.

Further, by swinging the dresser 2 to the center hole 100*a* of the lower platen 100 as shown by the dot-dash line of FIG. 9, the scraped off abrasive S will be discharged inside the center hole 100*a*, while by swinging the dresser 2 to the outer circumference 100*b* of the lower platen 100 as shown by the solid line, the abrasive S etc. will be discharged to the outside of the lower platen 100.

Further, in the pad 111 of the upper platen 110 as well, in the same way as above, the abrasive S etc. clogging the pad 111 will be scraped off by the cooperative action of the brush 11*a* and the scraper 12*a* and the scraped off abrasive S will be discharged by the swing of the dresser 2.

Here, the abrasive S is discharged not only by the swing force of the dresser 2, but also by the centrifugal force of the lower platen 100 and the upper platen 110, so is effectively discharged.

Note however that the pad 101 of the lower platen 100 and the pad 111 of the upper platen 110 are not necessarily flat. They may be worn down by the polishing work and develop inclined portions.

Figure 10:
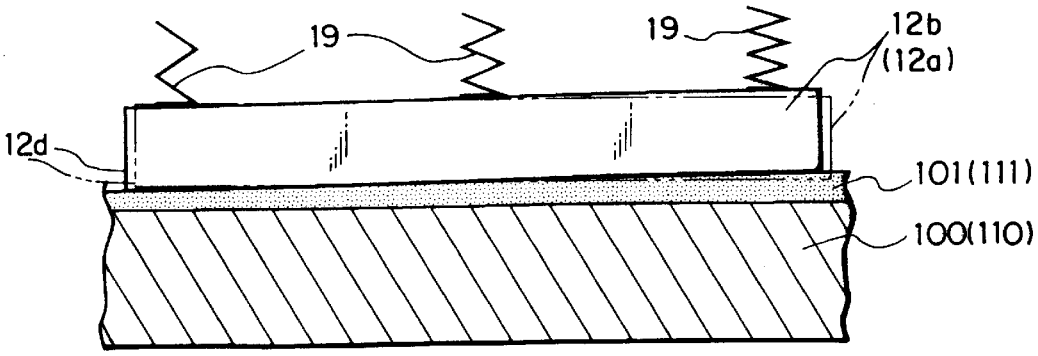
FIG. 10 is a schematic view of a state of follow by the scraper.

FIG. 10 is a schematic view of a state of follow by the scrapers 12*a* and 12*b*.

When the scrapers 12*a* and 12*b* are fixed to the dresser body 10, as shown by the dot-dash line of FIG. 10, there is an uneven distribution of pressure applied to the upper platen 110 by the blade portions 12*b* of the scrapers 12*a* and 12*b*. At the high portions, the blade portions 12*d* bite into the pads 101 and 111, while at the low portions, the blade portions 12*d* float above them. As a result, the pads 101 and 111 may be damaged or the dressing may become insufficient.

In the dressing apparatus 1 of this embodiment, however, the scrapers 12*a* and 12*b* are not fixed. They are merely biased in the outward direction by the springs 19.

Accordingly, at the inclined portions of the pads 101 and 111, the springs 19 contract in accordance with the inclination so that the scrapers 12*a* and 12*b* incline following the inclined portions of the pads 101 and 111 as shown by the solid line in FIG. 10. The blade portions 12*d* therefore press against the pads 101 and 111 by a substantially equal distribution of pressure.

As a result, it is possible to avoid damage to the pads 101 and 111 and insufficient dressing and possible to dress accurately.

When the dressing work is finished, an operation reverse to the operation shown in FIG. 7A to FIG. 7C is performed. That is, the drive of the swing mechanism 4 and the rotation of the lower platen 100 and the upper platen 110 are stopped, the upper platen 110 is made to rise, then the dresser 2 as a whole is made to rise by the elevating mechanism 6 and then returned to its original position by the rotating mechanism 5.

In this way, according to the dressing apparatus 1 of this embodiment, not only is it possible to dress the pads 101 and 111 automatically, but it is also possible to efficiently dress them by the cooperative action of the brushes 11*a* and 11*b* and the scrapers 12*a* and 12*b*. Further, effective dressing even with inclination of the pads 101 and 111 is possible.

Figure 11:
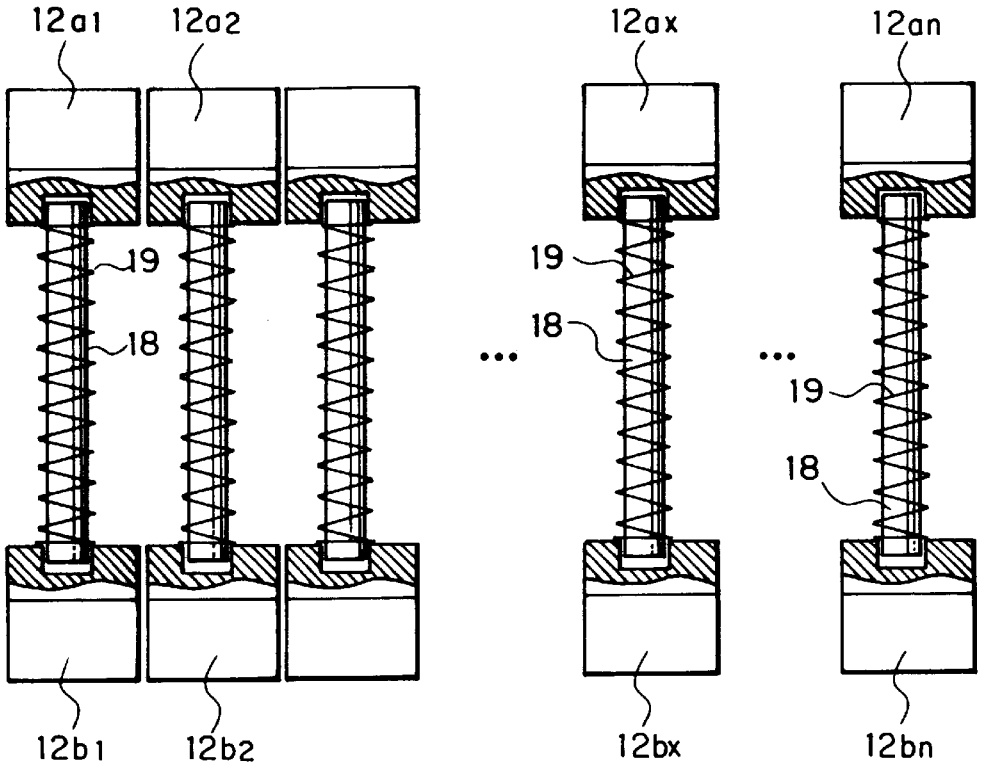
FIG. 11 is a side sectional view of a modification of the first embodiment.

FIG. 11 is a side sectional view of a modification of the first embodiment and corresponds to the invention set forth in claim 4.

That is, the scrapers do not have to be single members.

As shown in FIG. 11, they are divided into a plurality of scraper pieces 12*a*1 to 12*a*n and 12*b*1 to 12*b*n. The scraper pieces 12*a*x and 12*b*x (x=1 to n) are supported by the guide shafts 18 and are biased by the springs 19.

Figure 12:
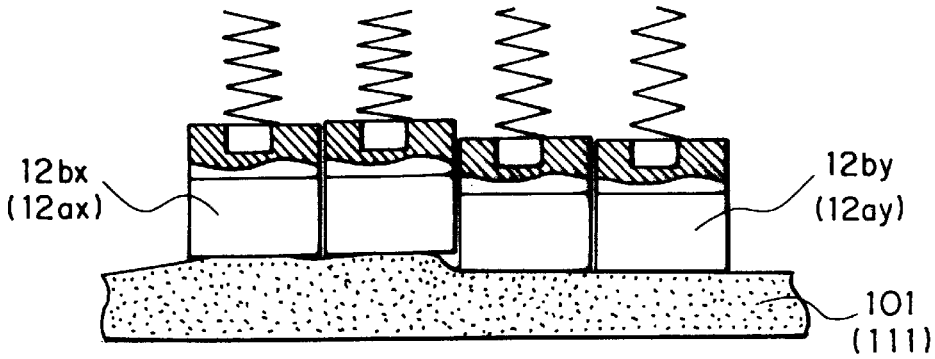
FIG. 12 is a schematic view of the state of follow by scraper pieces.

FIG. 12 is a schematic view of the state of follow by the scraper pieces.

With this configuration, as shown in FIG. 12, the scraper pieces 12*b*x to 12*b*y (12*a*x to 12*a*y) follow the unevenness of the pad 101 (111) so the dressing effect is further improved.

Figure 13:
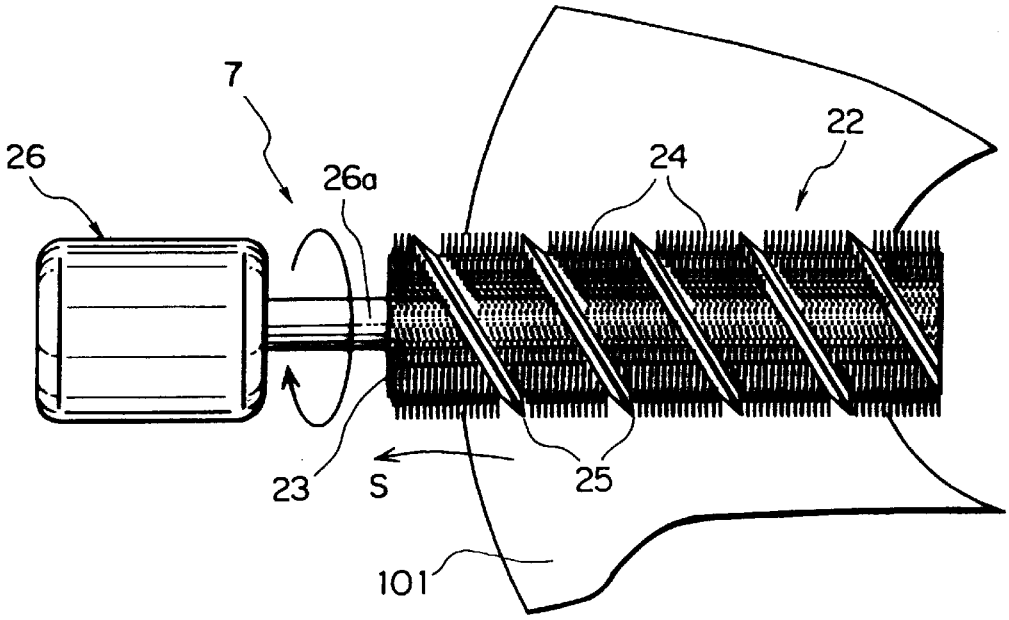
FIG. 13 is a plan view of a dressing apparatus according to a second embodiment of the present invention.

FIG. 13 is a plan view of an embodiment of a dresser according to the first aspect of the invention and a dressing apparatus according to a third aspect of the invention.

This embodiment differs from the first embodiment in the point that a similar effect is obtained as with swinging the dresser by just making the dresser rotate.

In FIG. 13, reference numeral 7 is a dressing apparatus of this embodiment. The dressing apparatus 7 is provided with a columnar dresser 22 and a motor 26 serving as the rotating mechanism.

The dresser 22 is comprised formed with a brush 24 over substantially the entire surface of the columnar dresser body 23 and provided with a spiral scraper 25 over the longitudinal direction of the dresser body 23. The motor 26 is linked by its shaft 26*a* to the center of the dresser body 23.

By this configuration, if the dresser 22 is placed on the pad 101 of the lower platen 100 so as to be oriented in the radial direction of the lower platen 100 and the motor 26 then driven, the dresser 22 will rotate in the circumferential direction and the pads 101 and 111 of the lower platen 100 or upper platen 110 (not shown) will be efficiently dressed by the cooperative action between the brush 24 and the scraper 25.

Further, since the brush 24 formed between the parallel sections of the scraper 25 in effect moves spirally, the scraped off abrasive S is discharged to the outside or the center of the platen.

In this way, according to the dressing apparatus of this embodiment, since a similar action as swinging is achieved without specially providing a swing mechanism, the cost of the product can be reduced by that extent.

The rest of the configuration, action, and advantageous effects are the same as those of the above embodiment, so will not be explained further.

Figure 14:
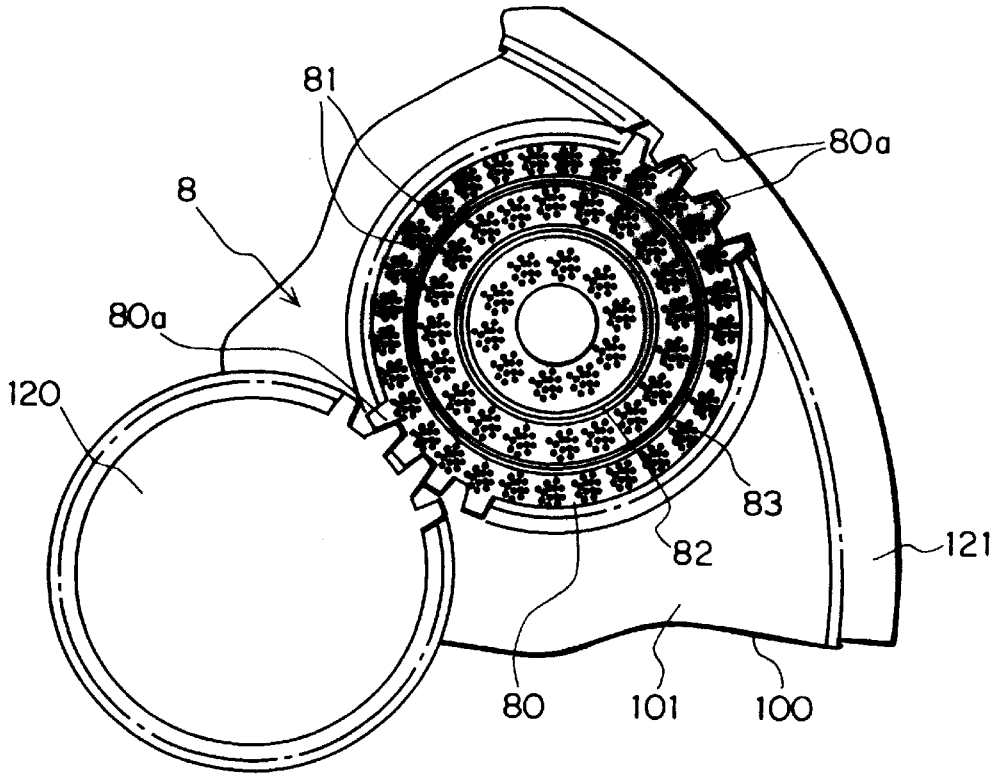
FIG. 14 is a plan view of a dressing apparatus according to a third embodiment of the present invention.
Figure 15:
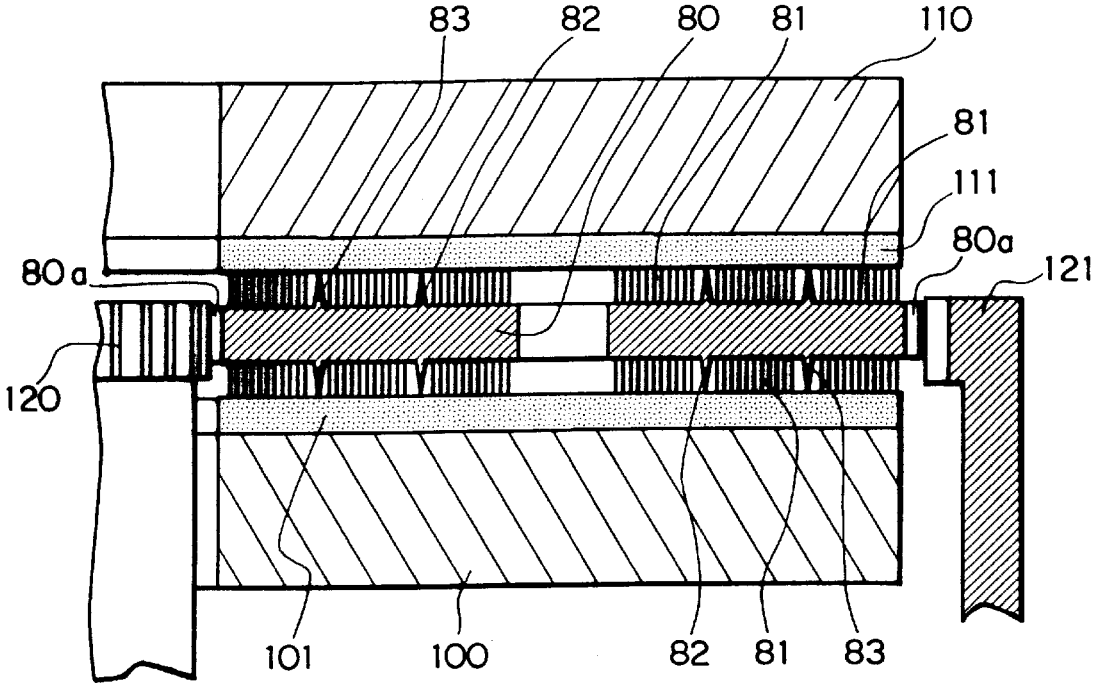
FIG. 15 is a side sectional view of the third embodiment.

FIG. 14 is a plan view of a dressing apparatus according to an embodiment of the first aspect of the invention set forth in claim 6 and claim 7, while FIG. 15 is a side sectional view of the same.

In these figures, reference numeral 8 is a dresser of this embodiment. The dresser 8 is one using the function of the carriers of a two-side polishing apparatus. The dresser body 80 forms a gear shape able to engage with the sun gear 120 and the internal gear 121.

Further, on the two surfaces of the dresser body 80 are formed brushes 81 and a pair of scrapers 82 and 83.

The pair of scrapers 82 and 83 form circular shapes concentric with the center of the dresser body 80 when viewed planarly.

By this configuration, by placing the gear portion 80*a* of the dresser body 80 on the lower platen 100 in a state engaged with the sun gear 120 and internal gear 121 and making the sun gear 120 rotate while pressing the dresser 8 against the upper platen 110, the dresser 8 rotates and revolves around the sun gear 120.

Due to this, the pads 101 and 111 of the lower platen 100 and the upper platen 110 are dressed by the rotating and revolving brushes 81 and the scrapers 82 and 83.

That is, according to the dresser 8 of this embodiment, the pad 101 is automatically dressed by just driving the two-side polishing apparatus, so there is no need to specially provide a mechanism for driving the dresser.

Note that in the dresser 8 of this embodiment, the pair of scrapers 82 and 83 was provided on the two surfaces of the dresser body 80, but the number is not limited. It is sufficient to provide one or more scrapers.

Further, whie the scrapers were formed in circular shapes, the invention is not limited to the same.

Figure 16:
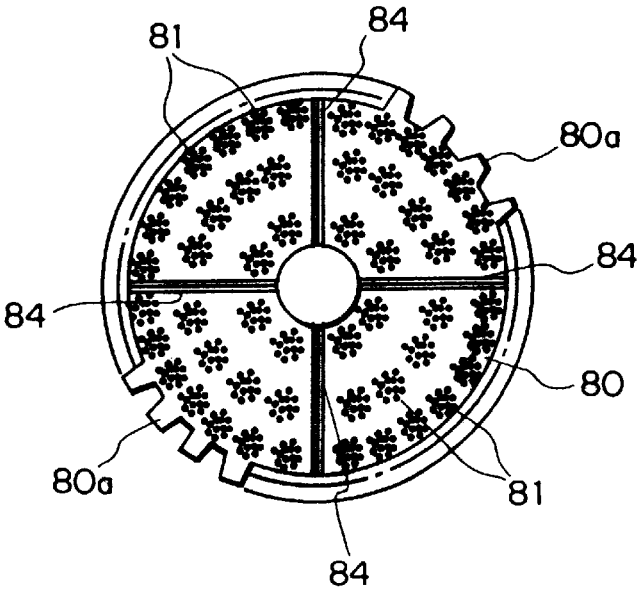
FIG. 16 is a plan view of a modification of the third embodiment.

FIG. 16 is a plan view of a modification of the third embodiment.

As shown in FIG. 16, it is also possible to form the brushes 81 on the two surfaces of the gear shaped dresser body 80 and provide straight shaped scrapers 84 so as to extend radially, that is, in the radial direction from the center of the dresser body 80.

Figure 17:
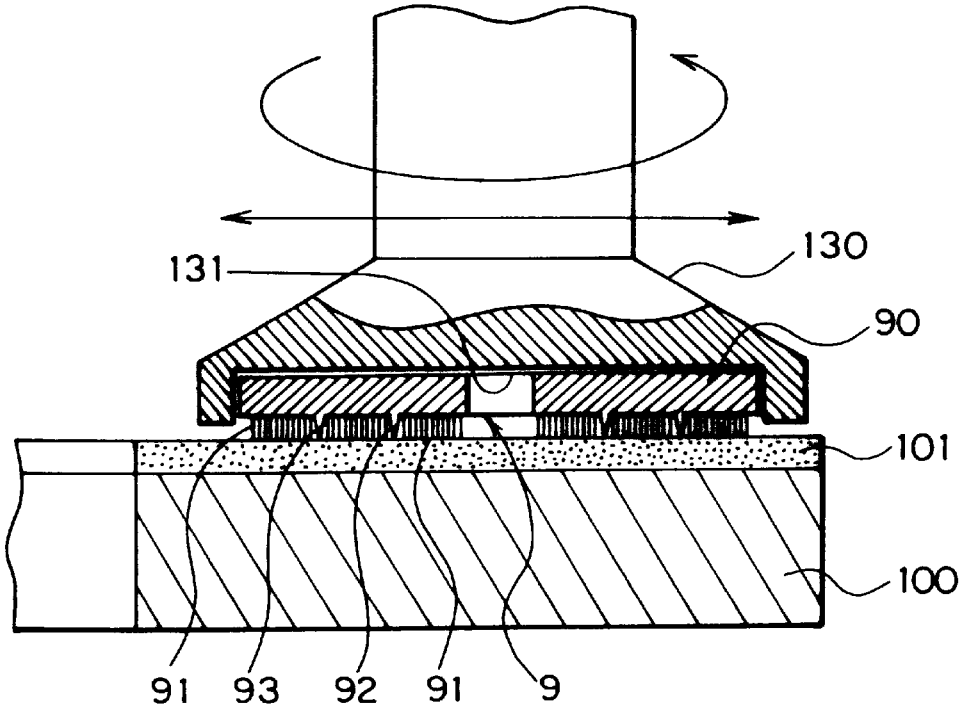
FIG. 17 is a side sectional view of a dresser according to a fourth embodiment of the present invention.
Figure 18:
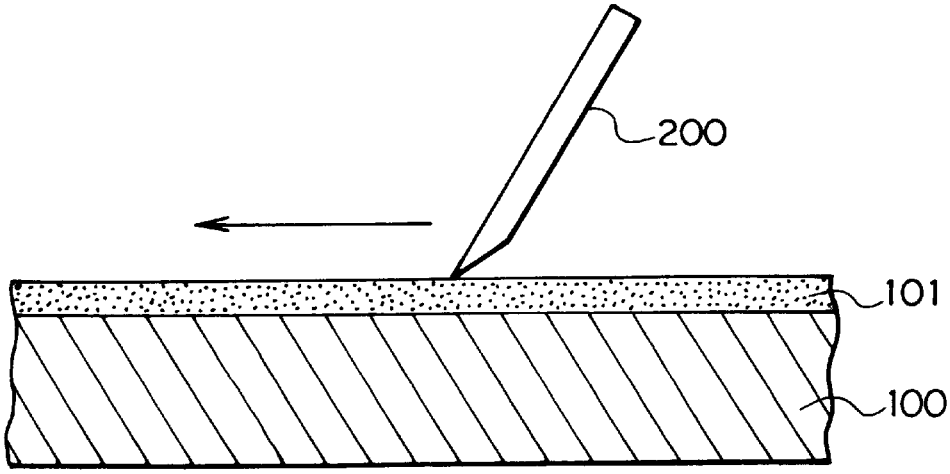
FIG. 18 PRIOR ART
FIG. 18 is a schematic side view of an example of the dressing technique of the related art.
Figure 19:
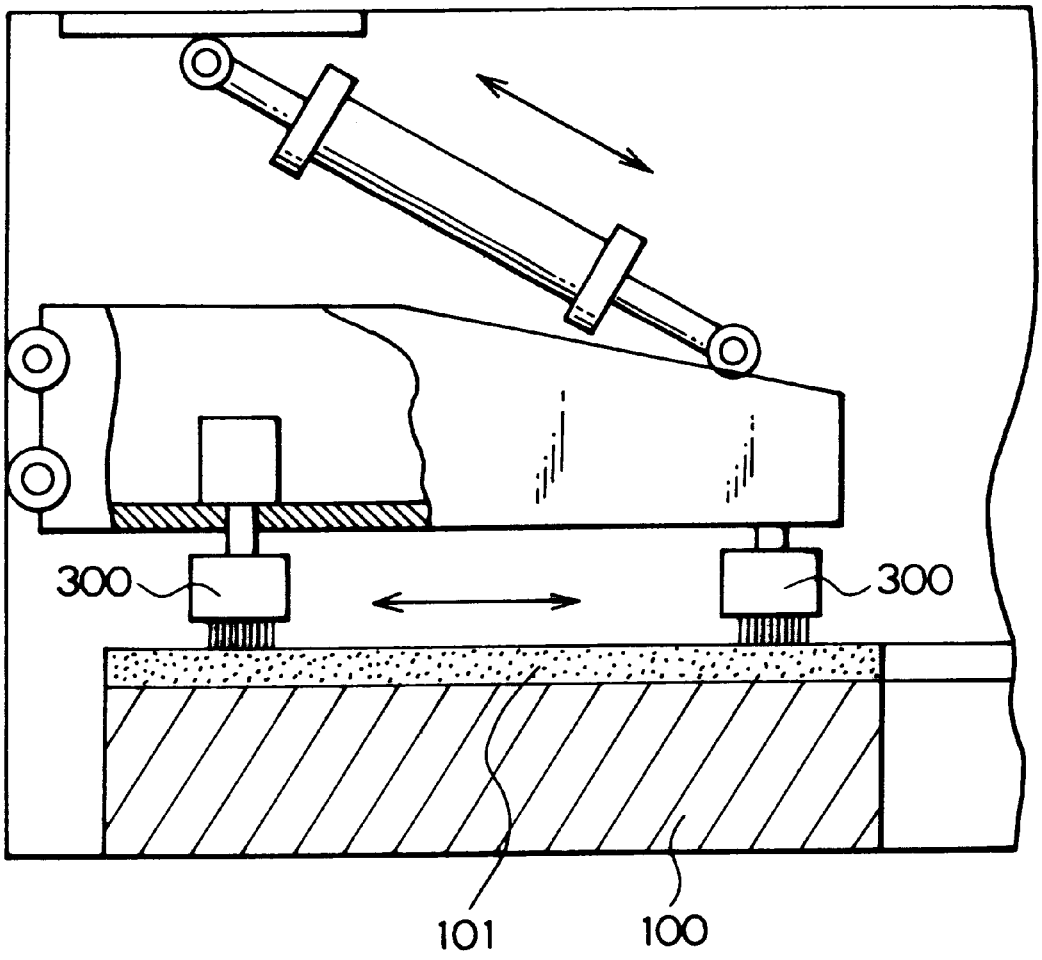
FIG. 19 PRIOR ART
FIG. 19 is a schematic side view of another example of the dressing technique of the related art.

FIG. 17 is a side sectional view of a dresser according to an embodiment of the first aspect of the present invention.

In FIG. 17, reference numeral 9 is a dresser of this embodiment. The dresser 9 has a configuration for dressing a platen of a one-side polishing apparatus.

That is, the dresser body 90 forms a disk shape able to be stored in a workpiece holding portion 131 provided at the lower surface of a head 130 of the one-side polishing apparatus. On its lower surface is formed a brush 91 and provided a pair of scrapers 92 and 93.

The scrapers 92 and 93, like the scrapers 82 and 83 of the third embodiment, are formed in circular shapes concentric to the center of the dressing body 90.

By this configuration, by pressing the dresser 9 held in the workpiece holding portion 131 against the lower platen 100 rotating at the head 130 and making the head 130 rotate and by making the dresser 9 swing in the radial direction of the lower platen 100, the pad 101 is dressed by the rotating and swinging brush 91 and scrapers 92 and 93.

That is, according to the dresser 9 of this embodiment, the pad 101 can be automatically dressed by just driving the one-side polishing apparatus.

The rest of the configuration, action, and advantageous effects are the same as those of the above embodiment, so will not be explained further.

As explained above in detail, since the abrasivee etc. clogging the pads etc. on the surface of the platens are scraped off by the cooperative action of the brushes and scrapers, a sufficient dressing effect can be obtained.

Further, since the scrapers can follow inclination of the pads etc., it is possible to avoid insufficient dressing or damage of the pads etc. and as a result the accuracy of the dressing is improved.

In particular, since a plurality of scraper pieces follow the complicated unevenness of the pads etc., the accuracy of the dressing is further improved.

Further, since the rotating spiral shaped scraper exhibits a similar effect to a swing motion, there is no need to make the dresser swing and the labor involved in the dressing work can be reduced by that amount.

Further, since the pads etc. of the upper and lower platens are automatically dressed by the rotating and revolving dresser by just driving the two-side polishing apparatus, there is no need to specially provide a mechanism for driving the dresser and as a result it is possible to reduce the labor involved in the work and reduce the cost of the products.

Further, since the pads etc. are automatically dressed by just driving the one-side polishing apparatus, it is possible to reduce the labor involved in the work and reduce the cost of the products.

Further, since it is possible to automatically discharge the abrasive etc. scraped off by the cooperative action of the brushes and scrapers by the swing mechanism, it is possible to further reduce the labor involved in the dressing work.

Further, by making the dresser rotate by the rotating mechanism, it is possible to automatically perform dressing and reduce the labor involved in the work.

What is claimed is:

1. A dresser comprising:

a dresser body having upper and lower surfaces, a bias means associated with the dresser body, a brush mounted for movement on both upper and lower surfaces of the dresser body into and out of the dresser body, a long rectangular knife-edge scraper of a predetermined length provided at both upper and lower surfaces of the dresser body, and long rectangular holes provided in both upper and lower surfaces of the dresser body, wherein the scrapers are fit into the holes from the inside of the dresser body and the scrapers are biased to project out from the dresser body by biasing members.

2. A dresser as set forth in claim 1, wherein:

the scrapers are divided into a plurality of scraper pieces and the plurality of scraper pieces are biased by a plurality of biasing members.

3. A dressing apparatus comprising:

a dresser having a dresser body having upper and lower surfaces, a bias means associated with the dresser body, a brush formed on both upper and lower surfaces of the dresser body, a long rectangular knife-edge scraper of a predetermined length mounted for movement on both upper and lower surfaces of the dresser body, into and out of the dresser body, and long rectangular holes provided in upper and lower surfaces of the dresser body wherein the scrapers are fit into the holes from the inside of the dresser body and the scrappers are biased to project out from the dresser body by biasing members, and a swing mechanism for making the dresser gripped between the upper platen and lower platen of a two-side polishing apparatus and with scrapers oriented in the radial direction of the upper platen and lower platen swing reciprocally in the above radial direction.

4. A dressing apparatus as set forth in claim 3, wherein:

the swing mechanism is provided with a slider linked to the base portion of the dresser, a link with one end pivotally supported by the slider, a crank by which the other end of the link is pivotally supported to an eccentric position, and a drive unit for making the crank turn.

5. A dressing apparatus as set forth in claim 3, wherein:

in the dresser, long rectangular holes are provided in the upper surface and lower surface of the dresser body, scrapers are fit into the holes from the inside of the dresser body, and the scrapers are biased to project out from the dresser body by biasing members.

6. A dressing apparatus as set forth in claim 5, wherein:

in the dresser, the scrapers are divided into a plurality of scraper pieces and the plurality of scraper pieces are biased by a plurality of biasing members.

* * * * *